United States Patent [19]

Tarassoff

[11] Patent Number: 4,563,955

[45] Date of Patent: Jan. 14, 1986

[54] CHAIRLIFT OR GONDOLA LIFT INCLUDING FRICTION DRIVE WHEELS

[75] Inventor: Serge Tarassoff, Fontaine, France

[73] Assignee: Pomagalski S.A., Fontaine, France

[21] Appl. No.: 624,281

[22] Filed: Jun. 25, 1984

[30] Foreign Application Priority Data

Jul. 6, 1983 [FR] France ..... 83 11475

[51] Int. Cl.[4] ..... B61B 12/00; B61F 19/00; B65G 45/00; B60S 3/04

[52] U.S. Cl. ..... 104/168; 104/173 ST; 104/279; 105/150; 198/497; 198/498; 15/256.5

[58] Field of Search ..... 15/256.5; 104/168, 173 R, 104/173 ST, 279; 105/150; 198/496, 497, 498, 499

[56] References Cited

U.S. PATENT DOCUMENTS

| | | | |
|---|---|---|---|
| 793,924 | 7/1905 | Dresser | 104/279 X |
| 1,017,208 | 2/1912 | Gardner | 104/279 X |
| 1,372,212 | 3/1921 | Wettervik | 104/279 X |
| 1,709,639 | 4/1929 | Vallely | 104/279 |
| 3,034,236 | 5/1962 | Pyke | 104/279 X |
| 3,416,462 | 8/1966 | Pomagalski | 104/202 |
| 4,400,272 | 9/1983 | Habegger | 104/279 X |
| 4,441,430 | 4/1984 | Brochand | 104/209 |

FOREIGN PATENT DOCUMENTS

| | | | |
|---|---|---|---|
| 56919 | 8/1982 | European Pat. Off. . | |
| 93680 | 11/1983 | European Pat. Off. | 104/173 R |
| 1505985 | 8/1969 | Fed. Rep. of Germany | 104/168 |
| 1933752 | 1/1970 | Fed. Rep. of Germany . | |
| 73315 | 6/1960 | France . | |
| 1419837 | 10/1965 | France . | |
| 2154918 | 5/1973 | France . | |
| 2069957 | 9/1981 | United Kingdom | 198/498 |

*Primary Examiner*—Randolph A. Reese
*Assistant Examiner*—David F. Hubbuch
*Attorney, Agent, or Firm*—Parkhurst & Oliff

[57] ABSTRACT

Chairlift or gondola lift with a carriage supporting a gondola or a chair and having a detachable grip for coupling on a continuously moving cable. In the terminals the carriage is uncoupled from the cable and it runs on a transfer rail. This transfer rail is equipped with friction drive wheels disposed along the carriage travel path for engaging the friction face of a running plate rigidly secured to the carriage so as to brake, accelerate or drive the carriage on the rail. During the night or bad weather periods a cover plate covers the friction face of the carriages disposed on the line and this cover plate is raised away in the terminals to clear the friction face. For removing the snow or ice which covers the friction face and hinders the correct friction drive of the carriage a brushing or rubbing device may be disposed along the carriage travel path so as to brush the friction face.

11 Claims, 12 Drawing Figures

FIG 6
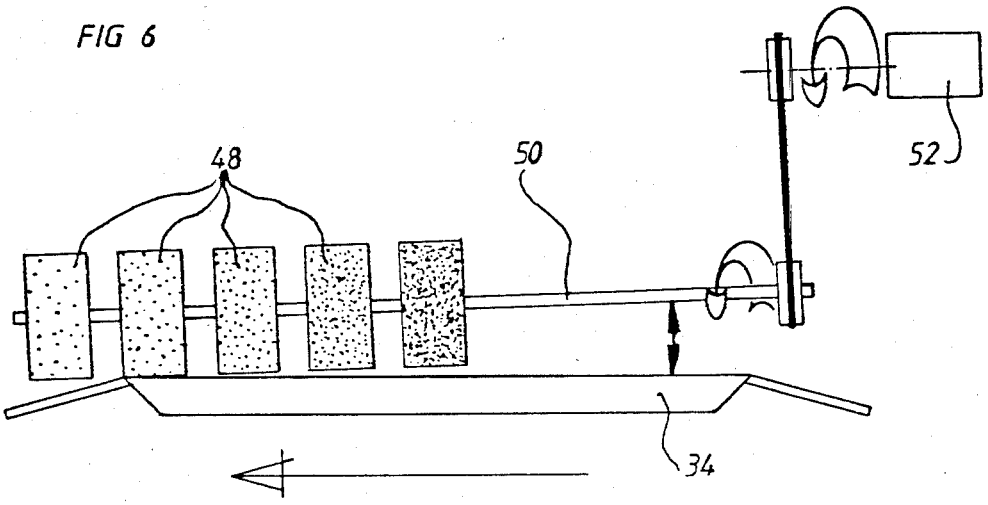
FIG 7
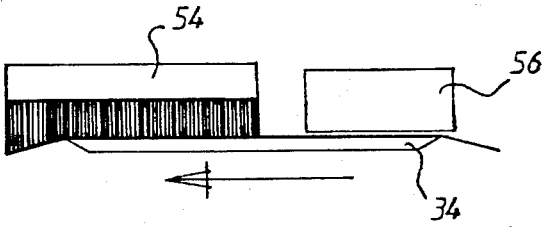
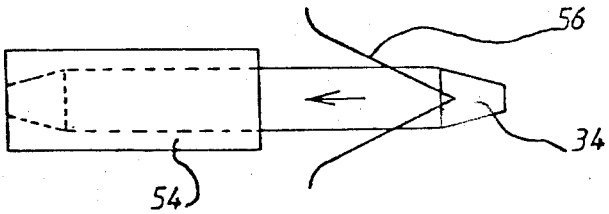
FIG 8

CHAIRLIFT OR GONDOLA LIFT INCLUDING FRICTION DRIVE WHEELS

BACKGROUND OF THE INVENTION

1. Field of the Invention

The invention relates to an overhead cable transport installation, in particular a gondola lift or a chairlift comprising a carriage with a detachable grip for coupling a load, in this case a gondola or a chair, on a continuously moving cable. The grip is of the detachable type permitting the uncoupling of the carriage from the cable in the stations or terminals and the running on a transfer guiding rail at a slow speed or the stopping of the gondola or chair at the loading or unloading platforms. The braking, acceleration and driving of the uncoupled grip carriage in the stations may be provided by wheels frictionly acting on a running friction plate rigidly secured to the upper side of the grip carriage body.

2. Description of the Prior Art

The U.S. patent application Ser. No. 334,078, issued as U.S. Pat. No. 4,441,430 on Apr. 10, 1984, discloses such a chairlift having a detachable grip which may remain fixed to the cable on the line during the night and which can still be safely and efficiently uncoupled and coupled to the cable notwithstanding the icing or snow. A problem resides in the driving of the grip carriage covered with snow and ice in the stations.

It is an object of the present invention to provide a correct circulation of the carriages in the stations.

Another object is to clear the friction plate of the grip from any snow or ice which may hinder the correct friction drive of the carriage.

SUMMARY OF THE INVENTION

To reach this objective, the invention includes a cover for covering the friction plate at least during the night, and this cover is automatically or manually removed when the grip carriage travels in the station. According to another embodiment the snow or ice is removed positively by means of a brushing or rubbing device, for instance a stationary brush or a rotatable brush disposed along the travel path of the grip carriage, for instance at the entrance of the station, so as to engage and to brush the friction plate. The brushing device includes a removable support so that it may be removed or brought into a rest position, away from the friction plate at the periods the grips being not iced or covered by snow. The brush may be metallic or of another suitable rigid material and is located so as to brush the plate longitudinally or transversely at the passage of the grip carriage. A snow scraper is advantageously disposed before the brush for removing a thick layer of snow. When the plate is iced the rubbing device includes a wheel with protruding nails or picks which penetrate and break the ice. For increasing this breaking effect the picks are slidably mounted and driven towards the protruded position to hammer the ice. One will select the appropriate cleaning or brushing device before starting the installation in the morning.

BRIEF DESCRIPTION OF THE DRAWINGS

Further objects and advantages of the invention will appear more clearly from the following detailed specification and annexed drawings in which:

FIG. 6 is a view similar to FIG. 4, showing a transverse brush device;

FIGS. 7 and 8 are views similar to FIGS. 4 and 5, showing an alternative embodiment of the brush device;

DETAILED DESCRIPTION

Figure 1:
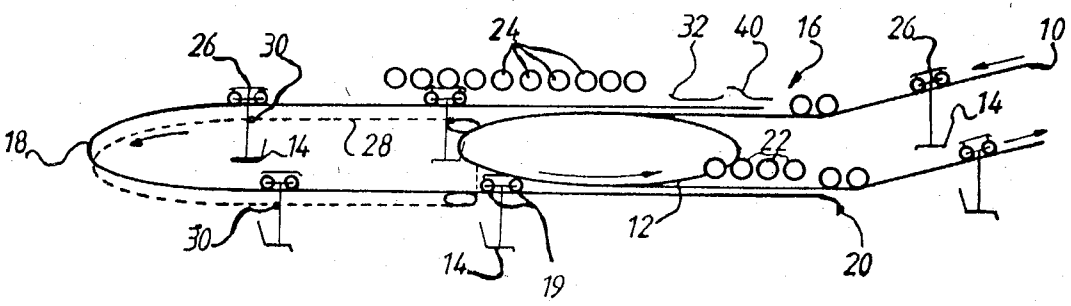
FIG. 1 is a schematic illustration viewed in perspective of a terminal station of a chairlift.

With reference to the drawings, a continuously running cable 10 of an aerial ropeway, in particular of a gondola or chairlift, leans from a bottom station to a top station, passing in these stations over a horizontal sheave 12 which guides the cable around to proceed back in the opposite direction, one of these sheaves being a driving sheave. The aerial ropeway may be of the endless monocable type or including a hauling cable and a separate track cable. At the entrance 16 in the station the chairs 14 are uncoupled from the cable 10 by opening of a grip 17 of the detachable type passing along a grip actuating lever 32. The grip 17 comprises a chair 14 carrying carriage 26 including wheels 19 for riding on a transfer support rail 18 in the station. The carriage 26 runs at a slow speed on the transfer rail 18, particularly for the loading or unloading of the passengers. At the exit 20 of the station, the grip carriage 26 is accelerated, for instance by running on an inclined section or rail by friction driving wheels 22 engaging the carriage 26 on an accelerating rail section, before the coupling on to the cable 10. The two stations are identical and only one is shown in FIG. 1. At the entrance 16 of the station the carriage 26 uncoupled from the cable 10 and running on rail 18 is decelerated by friction braking wheels 24 staggered along a decelerating rail section and each equipped with a pneumatic tyre which engages a running friction plate 34 of carriage 26. A transfer chain 28, having push fingers 30 which engage the carriage 26, extends along the transfer rail 18, but it is clear that the carriage 26 may be conveniently driven by a transfer cable, an escort car, friction wheels or similar conventional devices. Such a chair lift or gondola lift is well known and for instance described in U.S. patent application Ser. No. 570,687.

Figure 2:
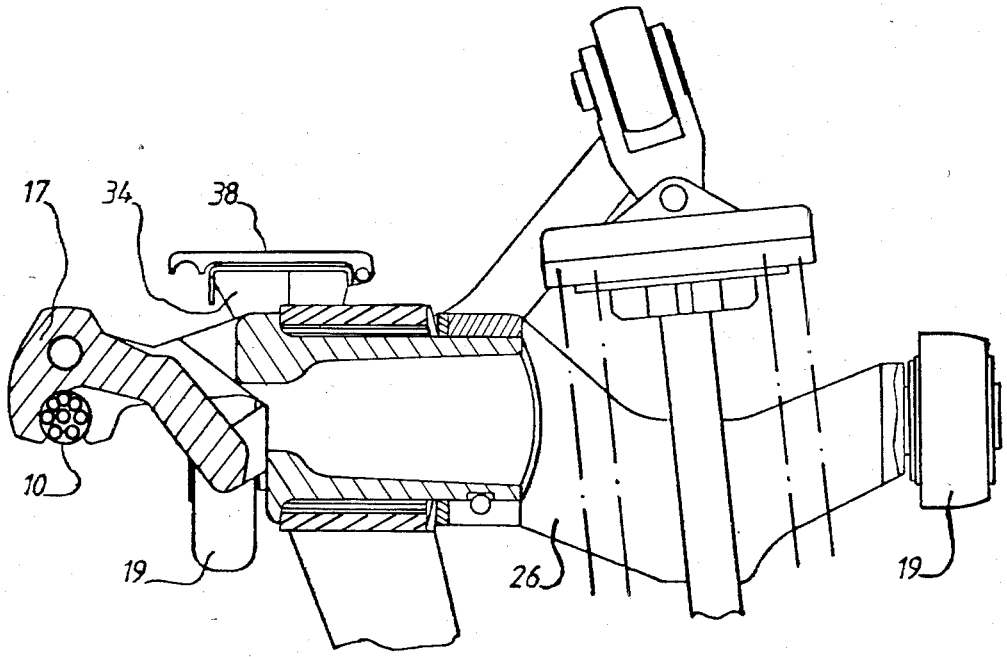
FIG. 2 shows a cross-sectional view of a grip, in the clamping position, of the chairlift shown in FIG. 1.
Figure 3:
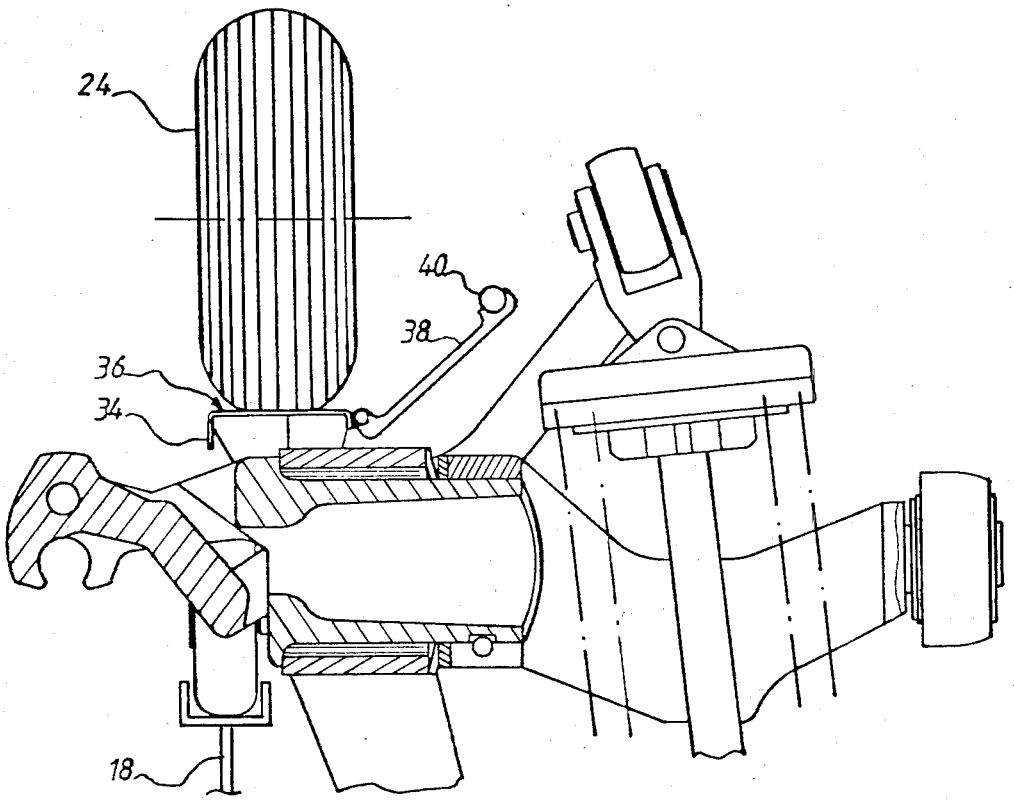
FIG. 3 shows the grip of FIG. 2 in the unclamping position and driven by a friction wheel.

Referring to FIGS. 2 and 3, the grip carriage 26 includes a running plate 34 which extends horizontally in the travel direction of the carriage. The upper face 36 of the plate 34 constitutes a friction face cooperating with the friction wheels 22, 24. A cover plate 38 is pivotally mounted on an axis along the longitudinal edge of plate 34. In the lowered position, shown in FIG. 2, the cover plate 38 covers the upper face 36 and in the raised position, shown in FIG. 3, the cover plate 38 clears the upper face 36. This pivotal movement may be carried out manually or automatically, for instance by a guide lever 40 which engages the cover plate 38 as the carriage 26 passes along an actuating section. Such actuating devices are well known and may be of the type commonly utilised to actuate the grips or the doors in a gondola lift.

The cover plate 38 is lowered onto face 36 during the rest periods of the chairlift, more particularly during the night and it protects the face 36 against the snow and the ice. When the chairlift is started in the morning the cover plate 38 is raised and the friction wheels 22, 24 cooperate with an upper face 36 free of snow or ice. The cover plate 38 can of course be lowered at each station exit of carriage 26 and removed at the entrance of the following station particularly during bad weather periods.

Figure 4:
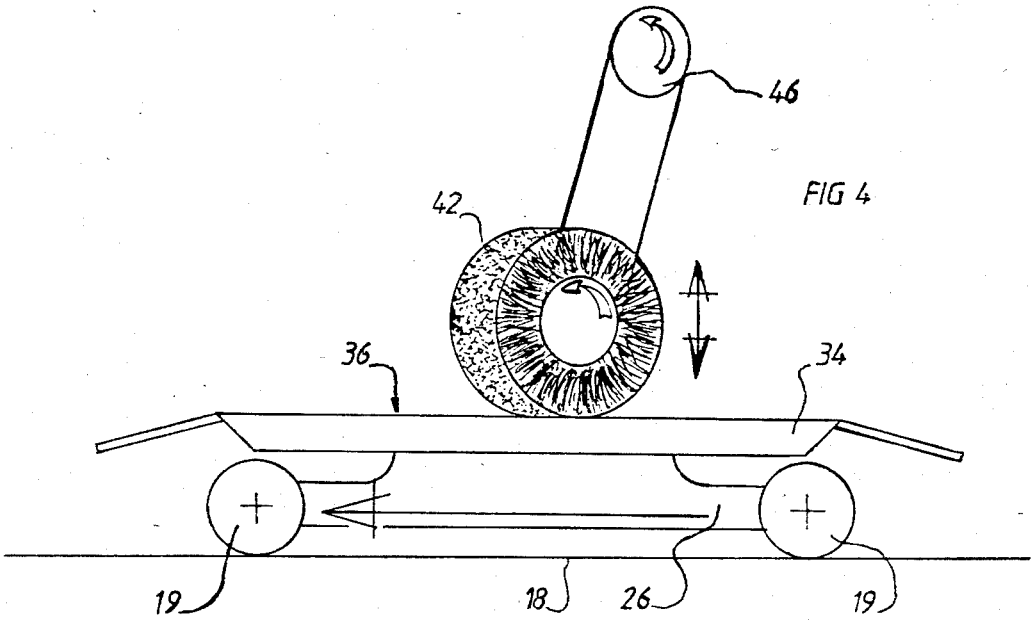
FIG. 4 is a schematic view in elevation of a friction plate at the moment when it travels along a longitudinal brush device.
Figure 5:
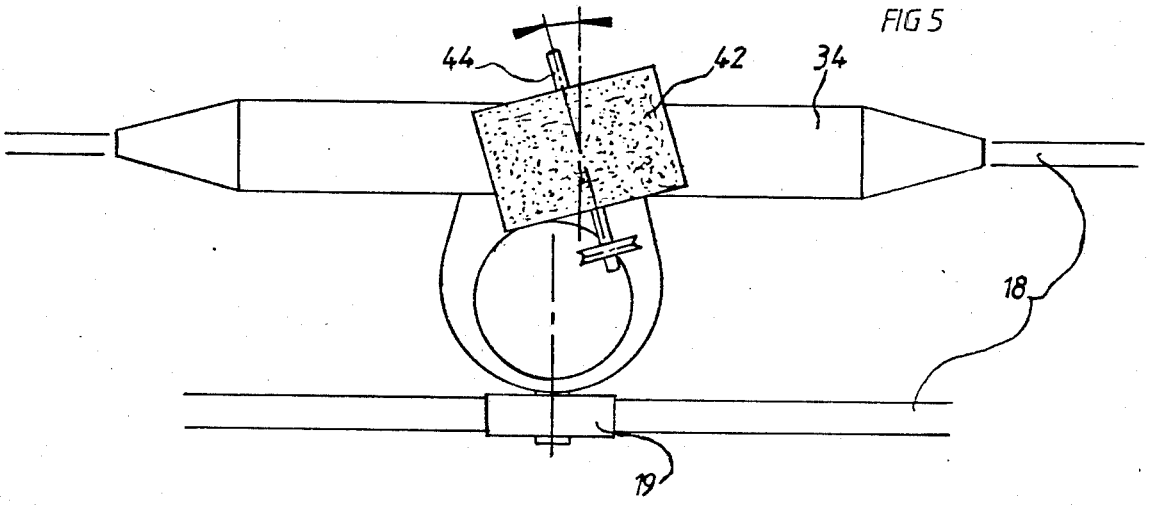
FIG. 5 is a plan view of FIG. 4.

Referring now to FIGS. 4 and 5, the manner in which the upper face 36 is positively cleaned by means of a rotative brush 42 is indicated. Brush 42 is rotatably mounted on an axis 44 perpendicular to or forming a slight angle with the perpendicular to the longitudinal plate 34 direction. Brush 42 is driven by an electric motor 46 or by similar drive means for instance powered by cable 10. Brush 42 is disposed above the travel path of plate 34 so as to brush the whole upper face 36 when the carriage 26 passes under the brush 42. The slight inclination of brush 42 facilitates the sideways, clearing away of the snow and the rotation of the brush 42 in a direction opposite to the carriage 26 travel direction increases the brushing effect. Likewise the brushing force may be increased by lowering brush 42 against face 36 and inversely. Brush 42 may be of metal or any other suitable material and may be shifted upwards or on the side towards a rest position when it is not necessary to brush plate 34.

Referring to FIG. 6, it will be noted that the brush 48 is rotatably mounted on an axis 50 which extends in the travel direction of carriage 26, which is represented on the drawing only by its friction plate 34. Five brushes 48 are staggered on the axis 50 which is driven by a motor 52. The friction plate 34 passes successively under the different brushes and the snow is brushed or shifted sideways from the upper friction face 36. The brushes 48 have various characteristics so that the first brush removes grossly the snow while the last brush cleans finely the upper face 36. Likewise the axis 50 is slightly inclined with respect to the friction plate 34 to increase the brushing force as the friction plate 34 moves along the brushes row. It is possible to utilize brushes 48 of various diameter to obtain the same effect.

Referring to FIGS. 7 and 8, it will be appreciated that the brush 54 is stationary so that the necessity of drive means is eliminated. In that case the brush 54 is advantageously preceded by a stationary snow scraper 56 which removes the main part of the snow. The cleaning efficiency of this stationary cleaning device is of course limited.

To remove an ice layer on plate 34 the chairlift is provided with a pneumatic tyre wheel 58 having nails 60 and being rotatably mounted on an axis perpendicular to the travel direction of carriage 26. Wheel 58 is driven by a motor 62 so as to move the nails 60 in the travel direction and at the same linear speed as the carriage 26, the nails 60 becoming incrusted in the ice. The pneumatic tyre pressure may be increased for obtaining a greater incrusting or rubbing force when the ice is very hard.

Figure 10:
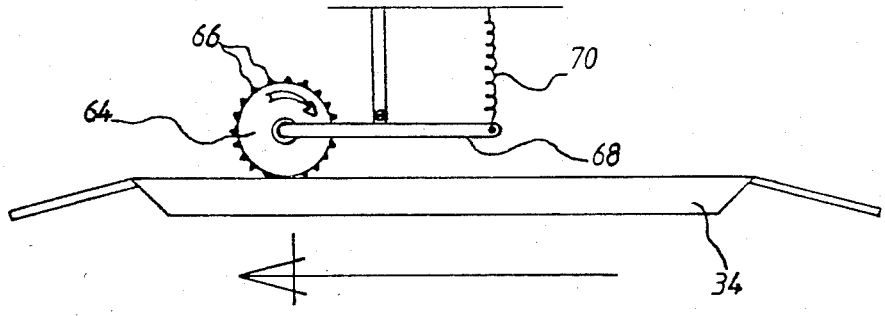

FIG. 10 shows a similar device including a rigid wheel 64 provided with picks 66 protruding from its running face. Wheel 64 is freely rotatable on an axis supported by a pivotally mounted lever 68 and is biased towards plate 34 by means of a spring 70 or a similar elastic device, such as a pneumatic acutator or a counterweight. The wheel 64 may be driven by a motor.

Figure 9:
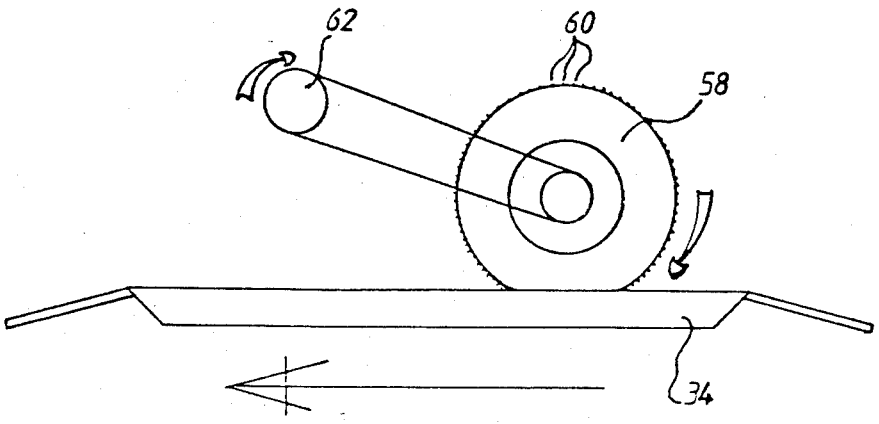
FIGS. 9, 10, 11 are views similar to FIG. 4, each view showing another embodiment.
Figure 11:
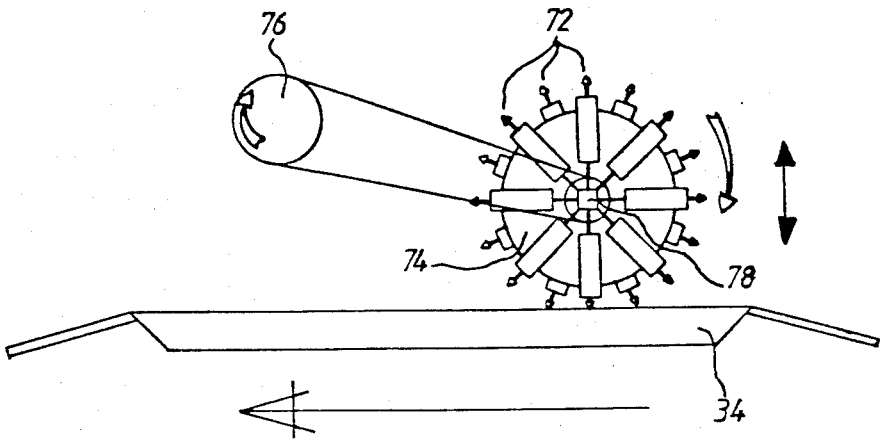
Figure 12:
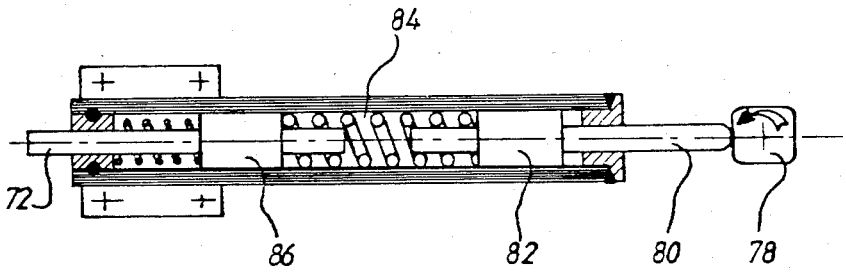
FIG. 12 is an enlarged fragmentary view in cross-section of the brush device of FIG. 11.

Referring now to FIGS. 11 and 12, a de-icing device similar to the one shown in FIG. 9 or 10, includes movable picks or pins 72. A wheel 74 is rotatably driven by a motor 76 and comprises a series of radially disposed cylinders 84, each receiving a slidably mounted piston 86 which supports a pick 72. A second piston 82 is slidably mounted in cylinder 84 and includes an actuating rod 80 which engages a cam 78 located on the wheel 74 axis. During a relative rotation of the wheel 74 with respect to cam 78 the latter pushes the pistons 82, 86 for hammering the plate 34 by the slidable pins 72.

All above described cleaning or brushing devices are advantageously located at the entrance of the station before the grip uncoupling zone, for engaging the friction plate 34 while the grip is still coupled on to the cable. These devices may be easily removed or shifted away for clearing the carriage travel path. A plurality of identical or different devices may be staggered along this carriage travel path to increase the cleaning effect.

I claim:

1. Overhead cable transport installation, in particular a gondola lift or a chairlift comprising:

a continuously moving endless overhead cable extending between two terminals, a transfer rail in each terminal for connecting the downhill line and the uphill line constituted by said endless cable, carriages, each supporting a gondola or a chair and having a detachable grip for coupling on said cable, support wheels for running on said rail in the terminal, and a plate extending in the carriage travel direction and including an upper friction face, a grip actuation device for uncoupling the grip from the cable at the entrance of the terminal, the carriage running on the transfer rail, at least one driven friction wheel disposed along the travel path of the grip carriage in the terminal for engaging said friction face for braking, accelerating or driving the carriage uncoupled from the cable and running on the transfer rail, clearing means disposed along the carriage travel path to clear said upper friction face from frozen precipitant before the passage of the carriage along said friction wheel so as to provide a correct friction drive of the carriage by said friction wheel.

2. Installation according to claim 1, said clearing means including a cover plate shiftable between a lowered position for covering said upper face upon travel or rest of the carriage on the line outside the terminal and raisable to a retracted position clearing said upper face for an efficient engagement by said friction wheel in the terminal.

3. Installation according to claim 2, wherein said cover plate is pivotally mounted on an axis extending along the edge of said friction face and wherein said installation comprises a plate actuating means disposed along the carriage travel path for pivoting away said plate from said friction face as the carriage travels along.

4. Installation according to claim 1, wherein said clearing means includes brushing means disposed along the travel path of said carriage, so as to brush said friction face at the passage along of the carriage.

5. Installation according to claim 4, wherein said brushing means comprises a brush rotatably mounted on an axis extending substantially perpendicular to the carriage travel path and brush driving means for rotating said brush, so that the brush bristles engaging said friction face and the carriage travel in opposite directions.

6. Installation according to claim 4, wherein said brushing means comprises a row of brushes staggered along the carriage travel path and rotatably mounted on a common axis extending parallel to said travel path for engaging successively said friction face.

7. Installation according to claim 4, wherein said brushing means comprises a stationary scraper and a stationary brush disposed successively along the travel path of said carriage.

8. Installation according to claim 1, wherein said clearing means includes rubbing means disposed along the travel path of said carriage, so as to rub said friction face at the passage along of the carriage.

9. Installation according to claim 8, wherein said rubbing means comprises a rotatable wheel having picks or nails protruding from the wheel tread, said wheel being rotatable so that the picks engaging the friction face and the carriage travel in the same direction.

10. Installation according to claim 1, wherein said clearing means includes hammering means disposed along the travel path of said carriage, so as to hammer said friction face at the passage along of the carriage.

11. Installation according to claim 10, wherein said hammering means comprises a rotatable wheel having picks or nails protruding from the wheel tread, said wheel being rotatable so that the picks engaging the friction face and the carriage travel in the same direction, and wherein said picks are slidably mounted on said wheel for moving radially outwardly and inwardly, said wheel including picks drive means, so as to hammer said friction face.

* * * * *